US008178833B2

(12) United States Patent
Willoughby et al.

(10) Patent No.: US 8,178,833 B2
(45) Date of Patent: May 15, 2012

(54) HIGH-FLOW TUBE FOR SAMPLING IONS FROM AN ATMOSPHERIC PRESSURE ION SOURCE

(75) Inventors: Ross Clark Willoughby, Pittsburgh, PA (US); Edward William Sheehan, Pittsburgh, PA (US)

(73) Assignee: Chem-Space Associates, Inc, Pittsburgh, PA (US)

( * ) Notice: Subject to any disclaimer, the term of this patent is extended or adjusted under 35 U.S.C. 154(b) by 361 days.

(21) Appl. No.: 12/156,254

(22) Filed: May 30, 2008

(65) Prior Publication Data

US 2008/0296493 A1 Dec. 4, 2008

Related U.S. Application Data

(60) Provisional application No. 60/932,706, filed on Jun. 2, 2007.

(51) Int. Cl.
*H01J 49/06* (2006.01)

(52) U.S. Cl. ..... 250/281; 250/282; 250/283; 250/288

(58) Field of Classification Search ..... 250/281, 250/282, 283, 288
See application file for complete search history.

(56) References Cited

U.S. PATENT DOCUMENTS

| | | | | |
|---|---|---|---|---|
| 4,542,293 | A | 9/1985 | Fenn et al. | |
| 4,977,320 | A | 12/1990 | Chowdhury et al. | |
| 5,736,740 | A | 4/1998 | Franzen | |
| 5,747,799 | A | 5/1998 | Franzen | |
| 5,756,994 | A | 5/1998 | Bajic | |
| 6,359,275 | B1 | 3/2002 | Bertsch et al. | |
| 6,486,469 | B1 | 11/2002 | Fischer et al. | |
| 6,583,407 | B1 | 6/2003 | Fischer et al. | |
| 6,583,408 | B2 | 6/2003 | Smith et al. | |
| 6,888,132 | B1 | 5/2005 | Sheehan et al. | |
| 6,914,243 | B2 * | 7/2005 | Sheehan et al. | 250/288 |
| 6,943,347 | B1 * | 9/2005 | Willoughby et al. | 250/288 |
| 6,992,299 | B2 | 1/2006 | Lee et al. | |
| 7,060,976 | B2 | 6/2006 | Sheehan et al. | |

(Continued)

FOREIGN PATENT DOCUMENTS

WO WO 03/010794 2/2003

OTHER PUBLICATIONS

Linn, B., et al., Ion transport by viscous gas flow through capillaries, J Am Soc Mass Spectrom 5, pp. 873-885 (1994).

(Continued)

*Primary Examiner* — Bernard E Souw
*Assistant Examiner* — Nicole Ippolito

(57) ABSTRACT

An improved ion sampling tube designed to increase the amount of current delivered into the vacuum system of a mass spectrometer or other gas-phase ion or particle detectors or collectors. A device and method is disclosed that utilizes a tube with a high flow of ion entrained gas passing through the said tube. Said ions are directed from the tubular gas flow through an ion selective aperture and into an adjacent region and subsequently directed into a lower pressure region for detection or collection. The method is useful for enhancing the detection of analytes in solutions that are either nebulized or electrosprayed, and analytes present in gases. The method is also useful for isolating ionic species from the ion source from neutral gases and particles that may interfere or interact with analyte species. The method also decouples the high flow of the atmospheric pressure ion source from the low flow ion transmission into vacuum.

20 Claims, 9 Drawing Sheets

U.S. PATENT DOCUMENTS

| | | | | |
|---|---|---|---|---|
| 7,095,019 | B1 | 8/2006 | Sheehan et al. | |
| 7,122,789 | B2 | 10/2006 | Tan et al. | |
| 7,253,406 | B1 | 8/2007 | Sheehan et al. | |
| 2002/0185595 | A1 | 12/2002 | Smith et al. | |
| 2003/0034452 | A1 | 2/2003 | Fischer et al. | |
| 2005/0189486 | A1 * | 9/2005 | Fuhrer et al. | 250/287 |
| 2007/0181800 | A1 * | 8/2007 | Jolliffe et al. | 250/288 |
| 2008/0067348 | A1 | 3/2008 | Musselman | |
| 2008/0067358 | A1 | 3/2008 | Musselman | |
| 2008/0067359 | A1 | 3/2008 | Musselman | |
| 2008/0087812 | A1 | 4/2008 | Musselman | |
| 2008/0116371 | A1 * | 5/2008 | Wouters et al. | 250/288 |
| 2008/0245963 | A1 | 10/2008 | Land et al. | |
| 2009/0321655 | A1 * | 12/2009 | Makarov et al. | 250/396 R |

OTHER PUBLICATIONS

Zhou, L., et al., "Incorporation of a venture device in electrospray ionization," Anal Chem 75, pp. 5978-5983 (2003).

Hawkridge, A.M., et al., "Analytical performance of a venture device integrated into an electrospray ionization fourier transform . . . ," Anal Chem 76, pp. 4118-4112 (2004).

* cited by examiner

HIGH-FLOW TUBE FOR SAMPLING IONS FROM AN ATMOSPHERIC PRESSURE ION SOURCE

CROSS-REFERENCE TO RELATED APPLICATIONS

This application claims the benefit of provisional patent application Ser. 60/932,706, filed Jun. 2, 2007 by the present inventors. In addition this application is related to application Ser. No. 08/946,290, filed Oct. 7, 1997, now U.S. Pat. No. 6,147,345, granted Nov. 14, 2000; application Ser. No. 09/877,167, filed Jun. 8, 2001, now U.S. Pat. No. 6,744,041, granted Jun. 1, 2004; application Ser. No. 10/449,147, filed May 31, 2003, now U.S. Pat. No. 6,818,889, granted Nov. 16, 2004; application Ser. No. 10/661,842, filed Sep. 12, 2003, now U.S. Pat. No. 6,949,740, granted Sep. 27, 2005; application Ser. No. 10/688,021, filed Oct. 17, 2003, now U.S. Pat. No. 6,943,347, granted Sep. 13, 2005; application Ser. No. 10/785,441, filed Feb. 23, 2004, now U.S. Pat. No. 6,878,930, granted Apr. 12, 2005; application Ser. No. 10/863,130, filed Jun. 7, 2004, now U.S. Pat. No. 6,914,243, granted Jul. 5, 2005; application Ser. No. 10/989,821, filed Nov. 15, 2004, now U.S. Pat. No. 7,081,621, granted Jul. 25, 2006; and application Ser. No. 11/173,377, filed Jun. 2, 2005, now U.S. Pat. No. 7,060,976, granted Jun. 13, 2006.

GOVERNMENT SUPPORT

Not applicable.

BACKGROUND

Field of Invention

This invention relates to methods and devices for improved sampling of gas-phase ions formed at atmospheric or near atmospheric pressure through a tubular inlet assembly comprised of a field-free tube and ion-selective aperture or aperture array for introducing gas-phase ions into an adjacent region by biasing the electric potential of the ion-selective aperture. The ions are further collected and analyzed by a gas-phase ion detector, such as but not limited to a mass spectrometer, ion mobility spectrometer, a differential mobility spectrometer, or combination thereof.

BACKGROUND OF THE INVENTION

Description of Prior Art

Ion sources at or near atmospheric pressure (approximately 760 torr), such as, atmospheric pressure discharge ionization, chemical ionization, photo-ionization, or matrix assisted laser desorption ionization, and electrospray ionization, generally have low sampling efficiency through low cross-section conductance or transmission apertures and tubes; due to the dispersive fluid dynamical and electrostatic forces associated with conventional sources. Less than 1% [often less than 1 ion in 10,000] of the ion current emanating from the ion source is detected in the lower pressure regions of the present commercial interfaces for mass spectrometry.

We have previously taught that the electric fields present at the opening of tubes are dispersive (for example, U.S. Pat. Nos. 6,914,243 (2005), 6,943,347 (2005), and 7,060,976 (2006)). FIG. 1 show simulated trajectories of ions approaching the entrance to a tube from a) a 200 V/mm and b) a 2000 V/mm ion source region into the relatively field-free inner channel of the tube. A viscous [gas] flow velocity component is added to these ions in the direction along the tube axis that is approximately 1/100 of the speed of sound, a reasonable estimate for the entrance conditions of the tube. This simulation shows the electric field penetration from the source region creates significant dispersion of ions and loss of ions to the walls at the inlet. The loss of ions to the walls will generally have two consequences; first, in the case of conducting [metal] tubes, the ions will give up charge (usually through a redox process) or, second, in the case of dielectric materials [glass] ions will accumulate on the surface and further retard introduction of subsequent ions into the flow through the tube. Either way, the ions are primarily lost at or downstream of the entrance of the tube.

U.S. Pat. No. 4,542,293 to Fenn et al. (1985) demonstrated the utility of utilizing a dielectric [glass] tube, the entrance and exit of the tube coated with a metal layer, and a large electric potential difference along the axis of the tube, to transport gas-phase ions from atmospheric pressure into a low pressure region where the viscous forces within the tube push the ions against the electrical potential gradient. This technology has the significant benefit of allowing grounded needles with electrospray sources. Unfortunately, this mainstream commercial technology transmits only a fraction of a percent of typical atmospheric pressure generated ions into the vacuum chamber. The majority of ions are lost at the inlet of the tube due to the dispersive electric fields, at the inlet, dominating the motions of ions.

The requirement for capacitive charging of the tube for the transmission of ions, as well as, the acceptance or entry of ions into the tube, is highly dependent on the charges populating the inner- and outer-surface of the tube. This dependence of surface charging limits the acceptance and transmission efficiencies of Fenn et al.'s technology. Contamination of the large surface area of the inner-walls of the tube from condensation, ion deposition, particulate material or droplets can change the surface properties and therefore hence reduce these efficiencies. In addition, since a large amount of energy is stored within the tube, contamination can lead to electrical discharges and damage to the tube, sometimes catastrophic. Therefore, care must also be taken to keep the inner- and outer-surfaces of the tube clean and unobstructed, presumably in order not to deplete the image currents that flows on the outer- and inner-surfaces of the dielectric tube.

U.S. Pat. No. 4,977,320 to Chowdhury et al. (1990) and U.S. Pat. No. 6,583,408 B2 (2003) and patent application publication 2002/0185595 A1 (2002) both to Smith et al., demonstrated the use of a heated metal tube or an array of metal tubes (in Smith et al. case) to both generate and transmit ions into the vacuum chamber. The efficiencies of these devices are low as well. These technologies sample both ions and charged droplets into the tube where, with the addition of heat, ion desorption is facilitated. Drops undergoing coulomb explosions inside of the restricted volume of the tube will tend to cause dispersion losses to the inner walls were the charges are quickly neutralized and not resulting in the surface charging up. But similar to Fenn et al.'s dielectric tube, these techniques suffer the same limitation from losses at the inlet due to the dispersive electric fields, as described above.

In addition, Smith et al. uses an array of tubes to increase the flow and thus the flux of ions into the vacuum system. It is also a common practice to use larger diameter openings to increase the conductance of gas and ions into the vacuum system. These approaches requires larger capacity vacuum pumps leading to an expensive solution to the problem, but at the same time this technique is still limited by the dispersive electrostatic forces at the entrances to tubes.

U.S. Pat. No. 5,756,994 to Bajic (1998) demonstrated a similar technology by using a skimmer, in close proximity to a high electric field source (such as, electrospray and atmospheric pressure chemical ionization), with a large opening leading into a lower pressure region and then sampling the resulting beam of ions orthogonally. This technology also has the benefit of sampling a larger volume of gas, but unfortunately this technology delivers the ions into the lower pressure region as a beam not taking full advantage of the directional viscous forces at higher pressures, along with the same limitation from losses at the inlet, as described above.

Lin and Sunner (1994) studied a variety of effects on transmission through tubes or capillaries of glass, metal, and Teflon. A wide variety of parameters were studied including tube length, gas throughput, tube diameter, and ion residence time. Effects from space charge, diffusion, gas flow, turbulence, spacing, and temperature were evaluated and discussed. Some important insights where reported with respect to general transmission characteristics of tubes. However, they failed to identify field dispersion at the inlet as the first step in the loss of ions. In the case of glass tubes, this dispersion and eventual impact of the ions on the inner-surfaces of tube leads to charging of the inner-surfaces of the tube, thereby preventing ions from entering into the tube.

Several approaches have been proposed to eliminate or reduced the charging of the surfaces at the entry of glass or dielectric tubes—for example, in U.S. Pat. Nos. 5,736,740 (1998) and 5,747,799 (1998) both to Franzen; U.S. Pat. No. 6,359,275 B1 to Bertsch et al. (2002); and U.S. Pat. Nos. 6,486,469 B1 (2002) and 6,583,407 B1 (2003), and U.S. patent application publication 2003/0034452 A1 (2003) all to Fischer et al. Franzen (U.S. Pat. No. 5,736,740) proposed the use of a highly resistive coating on the inner surfaces of the tube or use tubes that are themselves highly resistive, such as, glass tubes, to prevent charge accumulation as a means to facilitate the focusing of ions toward the axis of the tube. Although it is difficult to distinguish this art from Fenn et al. (U.S. Pat. No. 4,542,293), in that the glass tubes in both approaches are highly resistive [or weakly conducting dielectrics]. Franzen does argue effectively for the need to control the inner surface properties and therefore the internal electric fields. Irregardless, Franzen's approach will suffer from the same limitations as Fenn's; that is loss of ions in the dispersive electric fields at the inlets of tubes and apertures.

Bertsch et al. proposed a similar approach to Franzen to prevent charging of the surface by coating the inner-surface. But unlike Franzen, Bertsch et al. coated the inner-surface of the tube near the entrance with a conductive material, thereby bleeding away any charge that builds up on the inner-surface of the entrance. Bertsch et al. eliminated surface charging while still keeping the benefits of the dielectric tube transport in the nondispersive region of the tube. This approach addressed the problem of charge accumulation on the inner-surfaces, but it does not remove the significant losses of ions at the inlet due to dispersion. Again, suffering the same limitations of Fenn et al.'s, Franzen's, and Chowhdury et al.'s devices—loss of ions at the inlet due to dispersive electric fields.

U.S. Pat. No. 5,747,799 to Franzen (1989) and W.O. patent 03/010794 A2 to Forssmann et al. (2003) addressed the need to focus ions at or into the inlet of tubes and apertures in order to enhance collection efficiencies by the use of a series of electrostatic lens at or in front of the inlet. In Franzen's device the ions are said to be first, attracted to the inlet by electrostatic potentials and once in the vicinity of the inlet the ions are entrained into the gas flowing into the tube or aperture by viscous friction. This invention fails to account for the dominance of the electric field on the motion of ions in the entrance region. At typical flow velocities at the entrance of tubes or apertures, the electric fields will dominate the motion of the ions and the ions that are not near the tube axis will be lose to the walls of the tube. With this device, a higher ion population can be presented to the conductance opening at the expense of higher field ratios across the aperture or along the tube but also at the expense of higher dispersion losses at the entrance to the tube.

Forssmann et al. described a series of electrodes, or funnel optics, upstream of the inlet of the tube in order to concentrate and direct ions toward or into the inlet. This approach utilized funnel optics in front of an electrospray source in order to concentrate ions on an axis of flow by imposing focusing electrodes of higher electrical potential than the bottom of the so called accelerator electrode (counter-electrode), the first electrode in the series. This device frankly will not work. The ions formed by the electrospray process will be repelled by this funnel optics' configuration with little to no transmission of ions to the inlet of the tube. Most of the inertial energy acquired by the ions in the source region lost due collisions with neutral gas molecules at atmospheric pressure; consequently the only energy driving the ions in the direction of the tube will be the gas flow which under normal gas flows would be insufficient to push the ions up the field gradient imposed by the funnel optics.

U.S. Pat. Nos. 6,486,469 B1 (2002) and 6,583,407 B1 (2003); and patent application publication 2003/0034452 A1 (2003) all to Fischer et al. utilized external electrodes and butted dielectric tubes to provide enhanced control of the electric fields within the tube. While Fischer et al. (U.S. Pat. No. 6,583,407 B1) utilized the conductive coating proposed by Bertsch et al. (U.S. Pat. No. 6,359,275 B1) to eliminate surface charging, all three devices do not address issues related to inlet losses due to dispersive electric fields at the inlets of tubes. In addition, all these devices still utilize significantly large dielectric inner-surfaces with the associated problems of surface charging, contamination, and discharge.

U.S. patent application publications 2008/0067348 A1 (2008), 2008/0067358 A1 (2008), 2008/0067359 A1 (2008) and 2008/0087812 A1 (2008) all to Musselman describe a tube, or multiple tubes, to sample a source of gas-phase ions and deliver the ions over a long distance to the inlet to a mass spectrometer. Publications 2008/0067348 A1 (2008), 2008/0067358 A1 (2008) and 2008/0067359 A1 (2008) describe a permeable barrier, such as mesh or a micro-channel plate, sandwiched between the exit of the tube and the inlet, while application 2008/0087812 A1 (2008) describes the tube leading into an evacuated region where ions are transferred into a downstream inlet by means of sampling the mach disk resulting from the gases exiting the tube and a potential difference between exit of the tube and the inlet. This process is very similar to a "gas momentum separator" commonly used as an interface between a gas chromatograph and a mass spectrometer and to the dielectric tubes leading into a vacuum chamber as described by Fenn et al. in the U.S. Pat. No. 4,542,293 (1985), Franzen in U.S. Pat. Nos. 5,736,740 (1998) and 5,747,799 (1998); and Fischer et al. in U.S. Pat. Nos. 6,486,469 B1 (2002) and 6,583,407 B1 (2003) and publication 2003/0034452 A1. This technology has been available from the early 1990's from Analytica of Branford (Branford, Conn., http://www.aob.com), Agilent Technologies (Palo Alto, Calif., http://www.agilent.com/chem) and Bruker Daltonics (Billerica, Mass., http://www.bdal.com).

We have taught in our previous U.S. Pat. Nos. 6,914,243 (2005), 6,943,347 (2005), and 7,060,976 (2006) that changing the electric fields at the entrance to capillaries or arrays of capillaries from diverging to converging; gas-phase ions can be introduced into the vacuum system of mass spectrometers. Nevertheless all of these tubes or capillaries heretofore known suffer for a number of disadvantages:

(a) The use of high electric potentials to focus gas-phase ions first towards and then into the opening of tubes causes the ions, from both high-field and low-field ion sources, to be lost at the entrance or near the entrance of a tube due to the dispersive electrostatic forces present at the entrance. The viscous forces leading to focusing and convergence of ions due to the flow of gas entering the tube is not sufficient to over-come these dispersive forces. FIG. 1 illustrates the decrease in ion transmission with an increase in the electrostatic focusing fields at the tube entrance.

(b) Tubes comprised of dielectric material offer poor inner surfaces for transporting ions when high electric potentials are present at the inlet. After the surfaces have been contaminated with ions that have been deposited due to the dispersive electrostatic forces, a charge builds up forming an electrostatic barrier at or near the opening that is smaller than the physical opening in effect making the "acceptance diameter" for the inlet smaller.

(c) Extending the metal coating at the entrance of dielectric tubes further into the tube only leads to pushing the ion deposition and contamination pass the entrance and further down the tube.

(d) Tubes comprised of metal do not suffer from the buildup of charge as do dielectric tubes but still ions are lost at the entrance due to the dispersive electrostatic forces and subsequent neutralization.

(e) To increase the flux of ions through tubes and apertures existing devices rely on increasing the flow of gas through the use of higher capacity vacuum pumps in the lower pressure regions leading to a costly solution for increasing the flux of gas-phase ions into the system.

(f) Existing inlets to chemical analyzers such as mass spectrometers, ion mobility, or differential mobility analyzers cannot accommodate the large gas flows through apertures and tubes needed to sample or swept gas-phase ions from a large volume while still operating within their operational parameters without the need for large capacity vacuum pumps.

BACKGROUND OF THE INVENTION

Objects and Advantages

Accordingly, several objects and advantages of the present invention are:

(a) to provide a tubular inlet which will accept a high flow of gas into the inlet for collecting and focusing charged droplets or gas-phase ions produced from atmospheric or near-atmospheric pressure ionization processes that is sufficient to overcome the dispersive electrostatic forces present at the inlet;

(b) to provide a tubular inlet which will separate an ion selective aperture from the higher fields of the source and optical well regions present at the entrance of the inlet;

(c) to provide a tubular inlet where the gas flow into and through the inlet is independent and orders of magnitude higher than the flow into an adjacent region, which leads into a mass spectrometer, for example, thus reducing the gas load on the vacuum system;

(d) to provide a tubular inlet where gas flows of 100's to 1000's of $cm^3$/min are obtainable causing gas-phase ions to enter and flow unobstructed through the inlet without impacting and contaminating the inner surfaces of the inlet;

(e) to provide a tubular inlet which will present an ion-selective aperture for reducing the flow of gas into a downstream adjacent region;

(f) to provide a tubular inlet which can prevent unwanted components, such as neutral particles or droplets, from being transferred into an adjacent region;

(g) to provide a tubular inlet where the composition of gas(es) in the inlet can be different from the composition in an adjacent region, such as the composition of the inlet can be comprised of particles, ions, or neutral gases at atmospheric or near atmospheric pressure, etc.; while the an adjacent region can be comprised of gas-phase ions, etc.

(h) to provide a tubular inlet which will present an ion selective aperture where gas-phase ions are transferred from the inlet into a downstream region by applying an electric potential across the ion selective aperture;

(i) to provide a tubular inlet which will present a field free or near-field-free region where desirable components, such as reactant species, gas-phase ions of standards, etc., can be added to reactive or coexist with gas-phase ions present in the inlet;

(j) to provide a tubular inlet where the gas flow through the tube is directed;

(k) to provide a tubular inlet to a gas-phase ion analyzer, such as a mass or ion mobility spectrometer, that can sample large volumes or reaction chambers more efficiently than existing inlets to the ion analyzers by utilizing substantial gas flows that are outside the existing operational parameters of the ion analyzers;

(l) to provide a tubular inlet where the source of gas-phase ions relative to an ion detector is not critical and independent of each other;

(m) to provide a tubular inlet where the ion source region is field free or near-field free as described in our U.S. Pat. Nos. 6,888,132 (2005), 7,095,019 (2006), and 7,253,406 (2007);

(n) to provide a tubular inlet which is independent of atmospheric or near atmospheric ion source type;

(o) to provide a tubular inlet that can be incorporated along with an atmospheric ion source, a field-free reaction or desolvation region, gases, electronics, controller(s), high voltage supplies, and gas-phase ion detector into a portable or bench-top chemical analyzer;

(p) to provide a method of selectively transmitting a large portion of the atmospheric pressure source's current into a downstream detector, while eliminating a significant portion of the particles and neutral gases present in the ion source.

Further objects and advantages are to provide an inlet which is simple to use and inexpensive to manufacture, which can be supplied in a variety of lengths, shapes, outside and inside diameters, be comprised of metal, dielectric materials, and combination of the two; which can be easily incorporated onto existing mass spectrometers; etc. Still further objects and advantages will become apparent from a consideration of the ensuing description and drawings.

SUMMARY

In accordance with the present invention a tubular inlet for introducing charged particles or gas-phase ions into a downstream region comprises a field free or near-field free tubular region, an ion selective aperture, a downstream region adjacent the ion selective aperture, where the gas flow through the tube is significantly higher than the flow into the downstream region. The novelty of this device is the manner in which the gas-phase ions are collected and directed into the tubular inlet by means of viscous flow and then transferred through the tube in a field free or near-field free flowing manner.

DRAWINGS

Figures

In the drawings, closely related components have the same number but different alphabetic suffixes.

REFERENCE NUMBERS IN DRAWINGS

Figure 1:
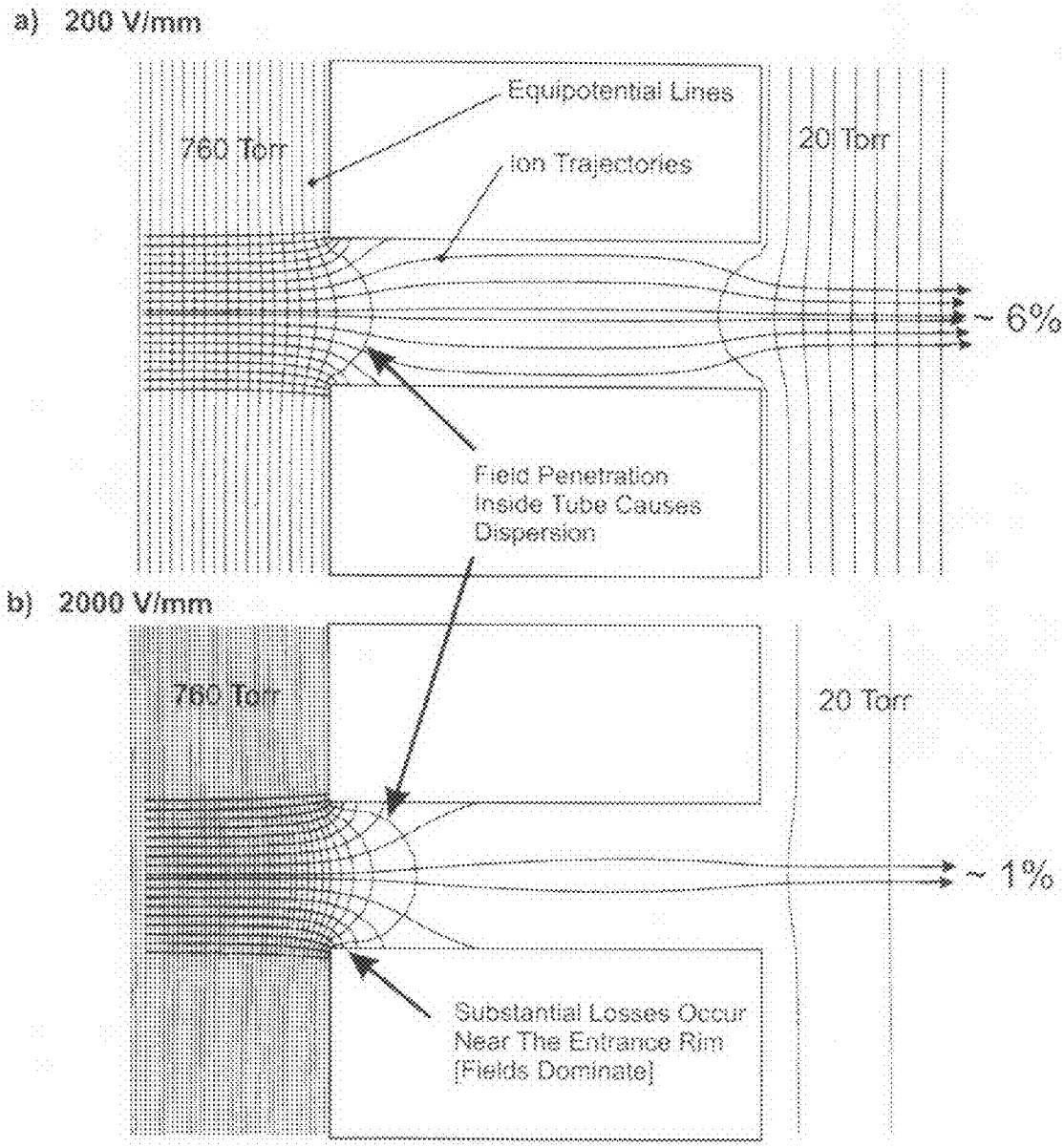
FIG. 1 (prior art) shows simulations of ion losses at the entrance region of tubes sampling ions from high field sources or optical wells showing, a) 200 V/mm and b) 2000 V/mm upstream field penetrating into a field-free conductance tube.

10 gas-phase ions
100 tube
102 exit
104 field-free or near field free region
110 ion selective aperture
112 openings
120 adjacent region
130 generalized ion trajectories
140 gas flow
150 opening in tube
160 mechanical van pump
170 concentric opening
200 remote reagent ionization generator
210 reagent ions
220 gas-phase species
230 product ions
240 source
242 delivery means

DESCRIPTION

Figure 2:
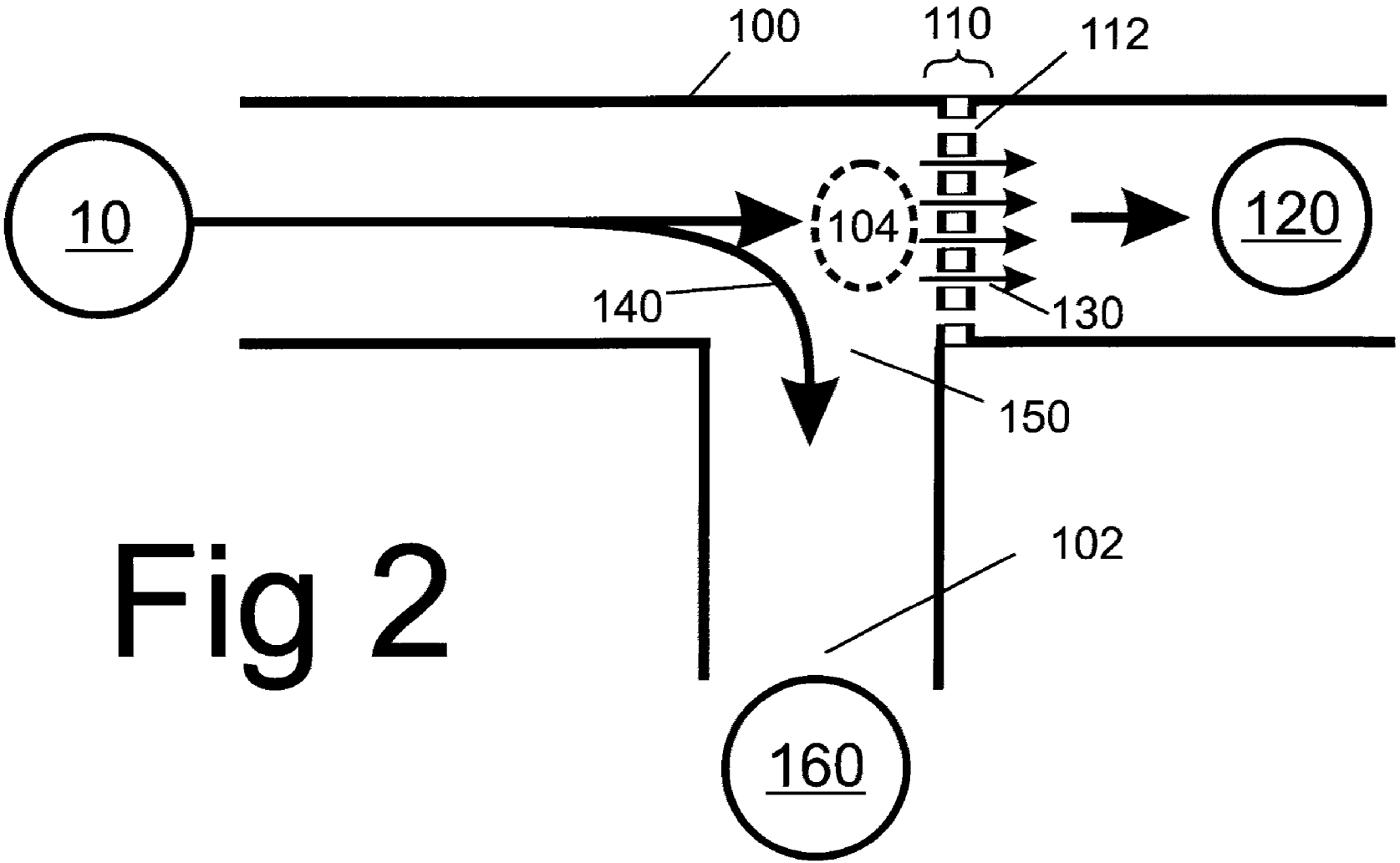
FIG. 2 shows a cross-sectional view of a tubular inlet with an axial ion selective aperture (ISA) array with orthogonal exhaust of tube flow.

FIG. 2—Preferred Embodiment

The present invention may be used to introduce gas-phase ions traveling through a field-free or near field-free tubular inlet or just tube inlet at or near atmospheric pressure into an adjacent region. The gas-phase ions 10 may be generated from a atmospheric pressure ion source, such as but not limited to a photo-ionization source, a remote reagent gas discharge source, atmospheric pressure chemical ionization source, an electrospray source, an electrospray desorption source, or an atmospheric pressure laser desorption source. In terms of gas discharge sources or atmospheric pressure chemical ionization sources, typical gases include but are not limited to nitrogen, air, water-saturated air or nitrogen, or helium. In terms of an electrospray source, typical solvents include, but are not limited to water, methanol, isopropyl alcohol, ethanol, acetonitrile or solutions containing some or all of the mentioned solvents; delivered to the nebulizer from a liquid source, such as but not limited to a high-performance liquid chromatograph (HPLC).

A preferred embodiment of the present invention is a tube inlet to a vacuum system, FIG. 2. The inlet is comprised of a tube 100, confining gas flow 140, an ion-selective aperture 110 positioned inside the tube 100, an adjacent region 120 downstream of the ion-selective aperture 110, an exhaust port 150 adjacent the ion-selective aperture 110, and an exit 102 from the tube. The region 104 directly upstream of the ion-selective aperture forms a field-free or near field-free region. The ion-selective aperture 110 in the context of this device has been previously described in our U.S. Pat. Nos. 6,914,243 (2005), 6,949,740 (2005), 7,060,976 (2006), and international patent publication WO 04/110583 A3 (2004); and is comprised of alternating layers or laminates of metal and insulating material with a plurality of openings or passages traversing the ion-selective aperture. Note that the ion-selective aperture in its simplest geometry would be a single flow path comprising laminates of at least two electrodes that are separated by a dielectric or insulating material. In this preferred embodiment all the ions flowing through the tube 100 are directed into the adjacent region 120 through the plurality of openings 112 in the ion-selective aperture 110, as shown by the generalized ion trajectories 130. A pump 160 is used to maintain a high flow of gas at or near atmospheric pressure along the entire length of the tube from the source of gas-phase ions 10 to the ion-selective aperture 110; exhausting neutral gases through tube opening 150.

All components of the device are generally made of chemically inert materials. The tube and metal laminates of the ion-selective aperture are comprised of conductive materials, such as stainless steel, brass, copper, gold, or aluminum. Alternatively the tube may be comprised of a dielectric material, such as but limited to fused silica, glass, resistively coated glass, etc.; and could be further comprised of separate parts—an dielectric body with metal sections or caps at the entrance and exit of the tube. Voltage power supplies (not shown) are connected to the metal laminates of the ion-selective aperture and the tube.

Figure 3:
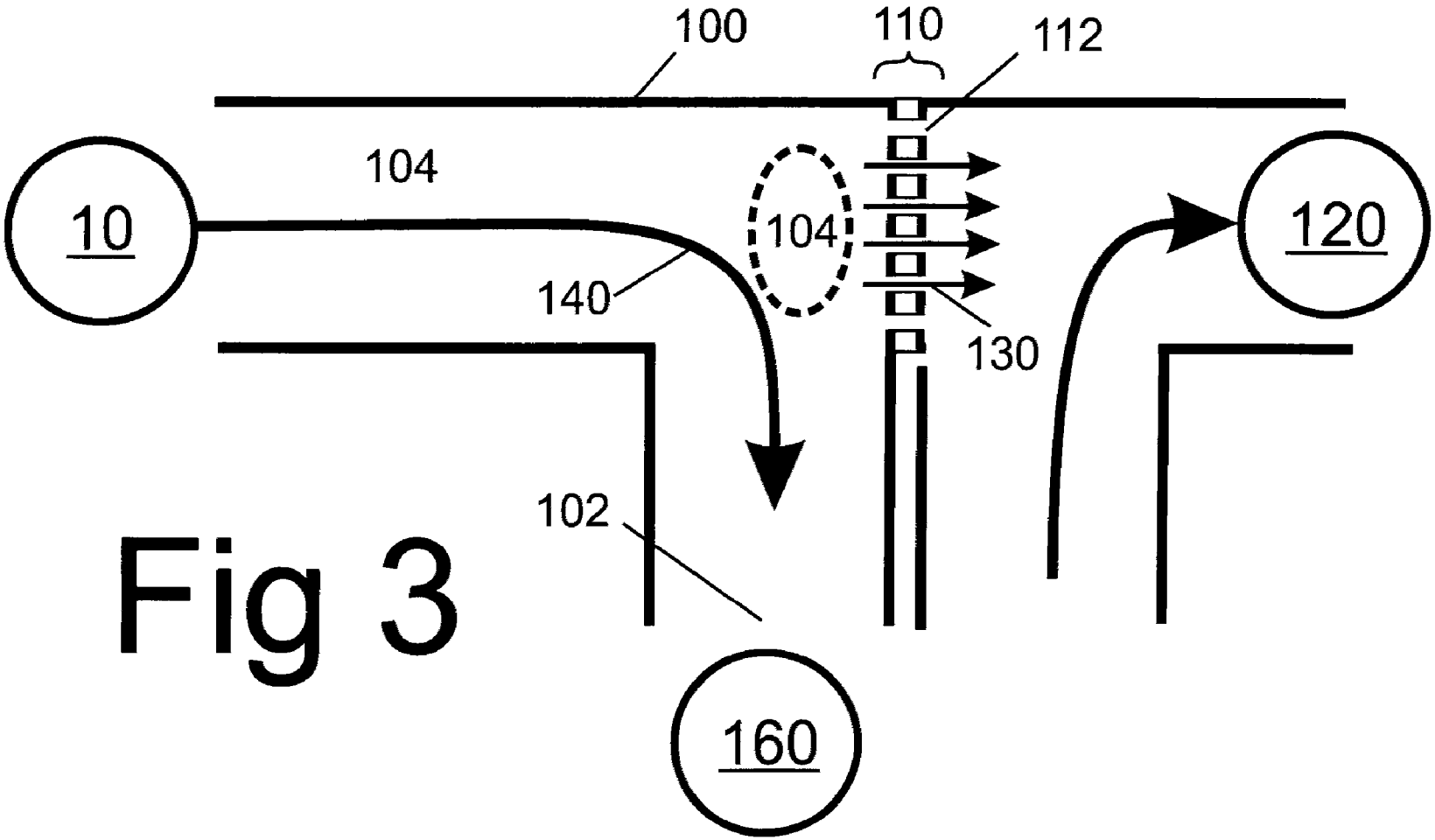
FIG. 3 shows a similar cross-sectional view of a tubular inlet with an axial ISA array with orthogonal exhaust upstream of the ISA and introduction of additional gas downstream from the ISA.
Figure 4:
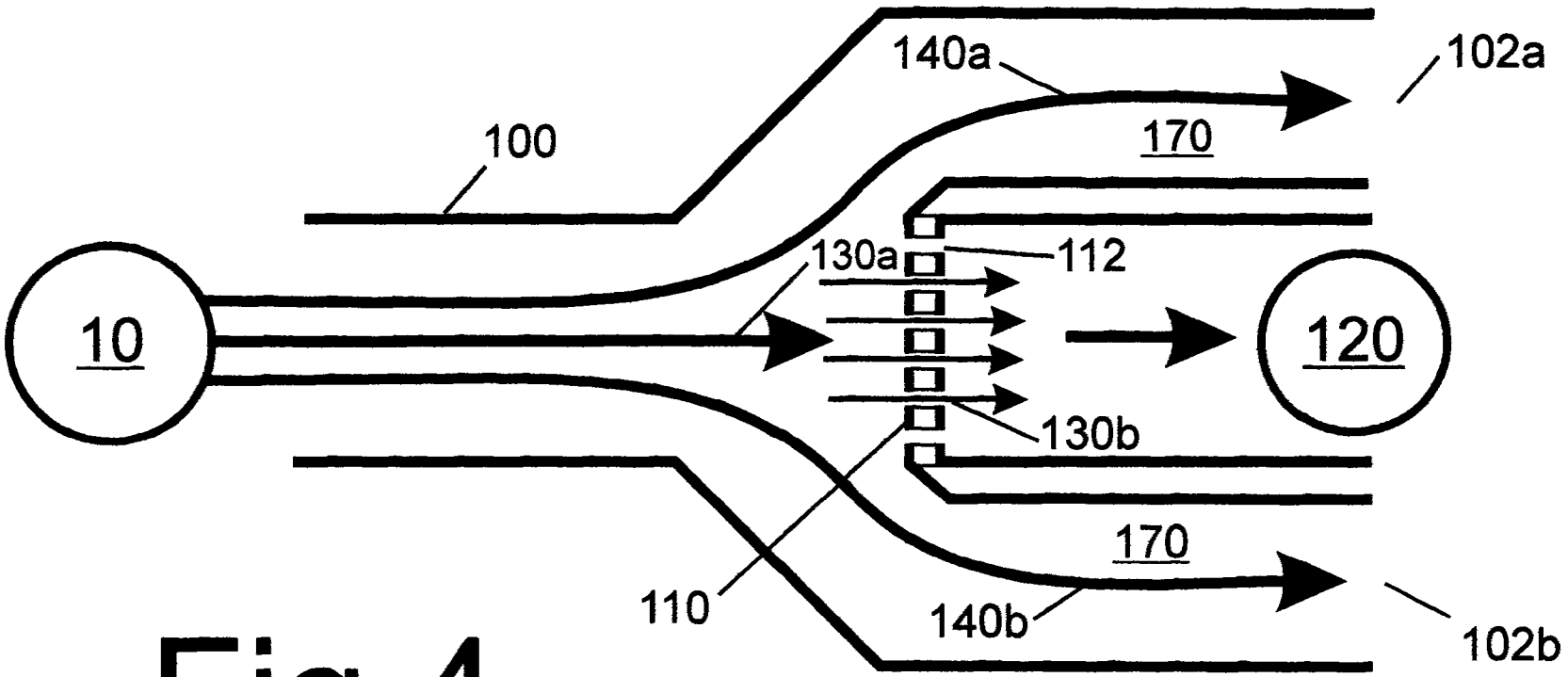
FIG. 4 shows a similar cross-sectional view of a tubular inlet with an axial ISA with a portion of the gas exiting the tube through a concentric opening axially aligned along the axis of the tube.

FIGS. 3 and 4—Additional Embodiments

An additional embodiment of the present invention is a tube inlet from source 10 to an adjacent region 120, see FIG. 3. The inlet is comprised of a tube 100, an exit 102 from the tube, confining gas flow 140, a field-free or near field-free region 104 directly upstream of an ion-selective aperture 110, and an adjacent region 120. Downstream of the ion selective aperture 110 is a second opening to allow additional gases to be added to prevent neutral gases from traversing the ion selective aperture 110 from upstream, while efficiently transferring ions toward region 120.

FIG. 4 illustrates a similar tube inlet from source 10 to adjacent region 120. The inlet is comprised of a tube 100, confining gas flow 140*a*, 140*b*, tube exit 102*a*, 102*b* and an adjacent region 120. The exhaust gas in this embodiment is removed co-axially with the axis of the ion selective aperture through concentric opening 170.

In each embodiment the amount of gas diverted from, delivered to, and exiting the tube is metered by means of a gas valve.

Adding Additional Ion-Selective Apertures

Figure 5:
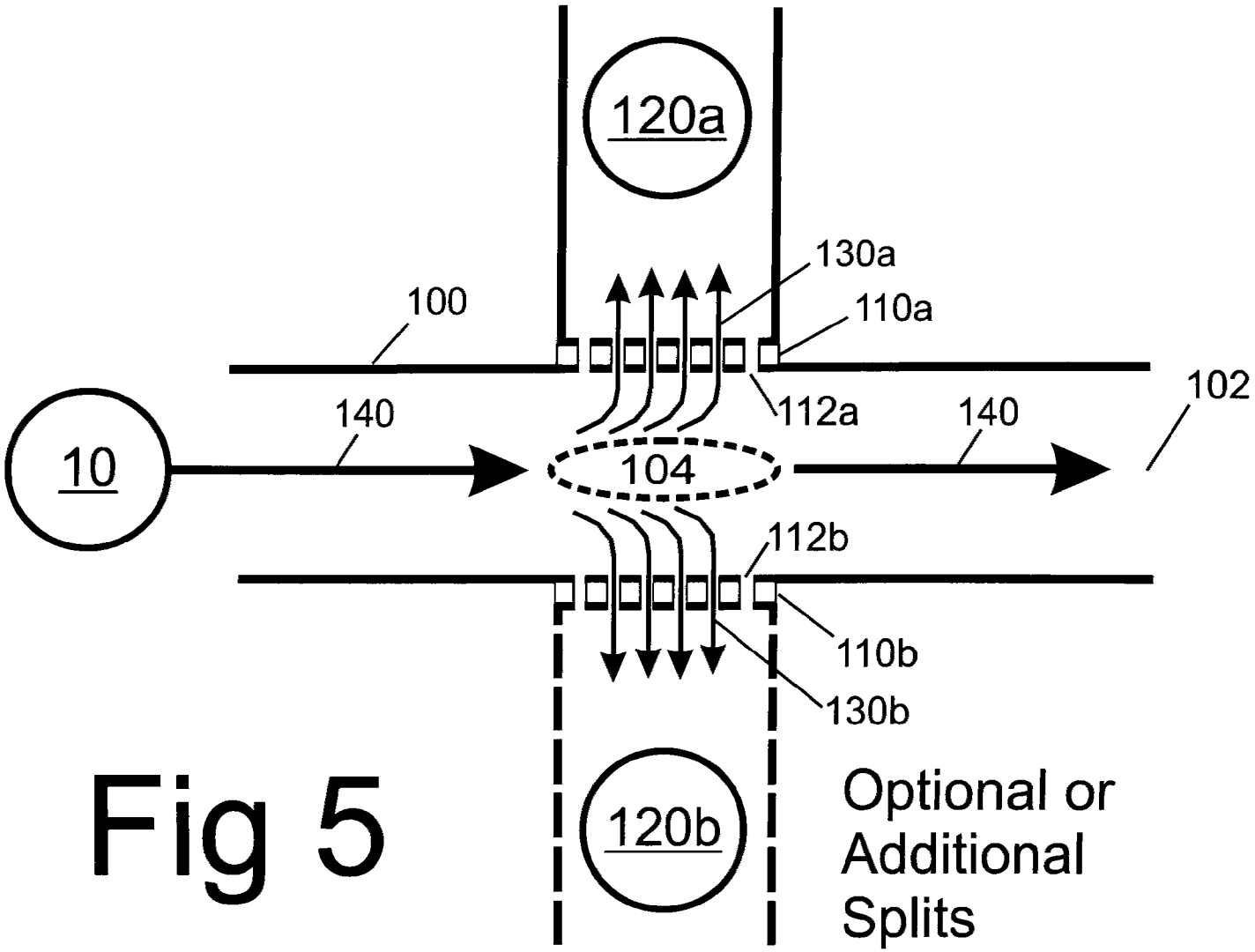
FIG. 5 shows a cross-sectional view of a tubular inlet with multiple orthogonal ISA's pulling ions off-axis from the axial flow of gases.

FIG. 5 illustrates a set of opposing ion-selective apertures 110*a*, 110*b* incorporated in the walls of a rectangular shaped tube 100. In this embodiment, the majority of the gas flow 140 passes by the ion-selective apertures exiting out of the tube exit 102 into a mechanical pump (not shown) while the ions of a prescribed polarity (in this case positive ions) are sampled orthogonal (as shown by their trajectories 130*a*, 130*b*) into and through each ion-selective aperture 110*a*, 110*b*.

Ion-Selective Apertures Sampling Positive and Negative Ions

Figure 6:
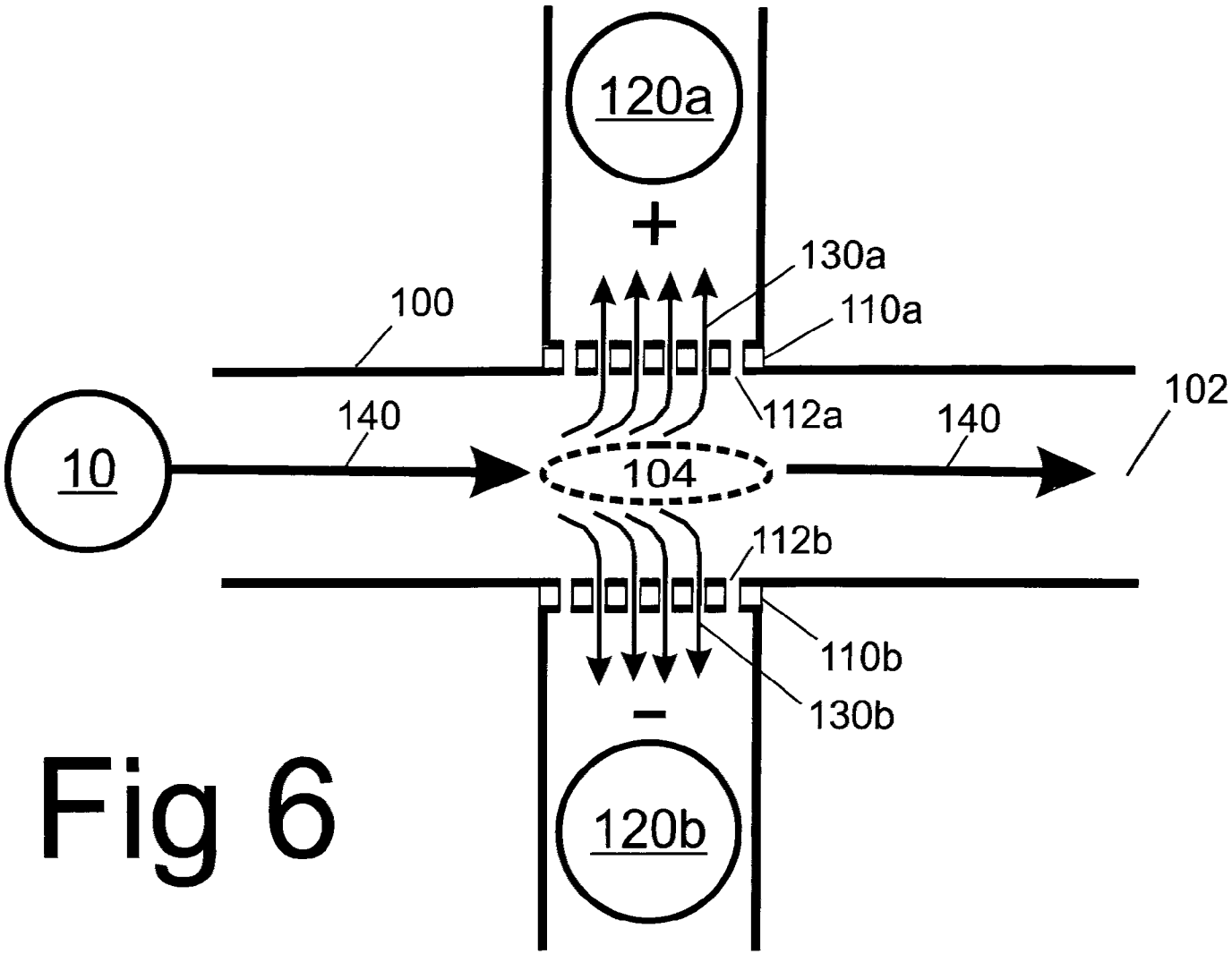
FIG. 6 shows a similar cross-sectional view of a tubular inlet with two sets of ISA's positioned in the walls of the tube, but in this case sampling gas-phase ions of different polarities.

FIG. 6 illustrates a similar configuration but in this instance the potentials of the laminates of one ion-selective aperture 110*a* are adjusted to sample positive ions (as shown by their trajectories 130*a*) from the gas stream 140 (and at the same time repel negative ions, as shown by their trajectories 130*b*, away and towards a second ion-selective aperture 110*b*) while the potential of the other ion-selective aperture 110*b* is adjusted to sample negatively charged ions from the gas stream 140, shown by their trajectories 130*b* (and at the same time repel positive ions away and towards, as shown by their trajectories 130*a*, the first ion-selective aperture 110*a*).

Figure 7:
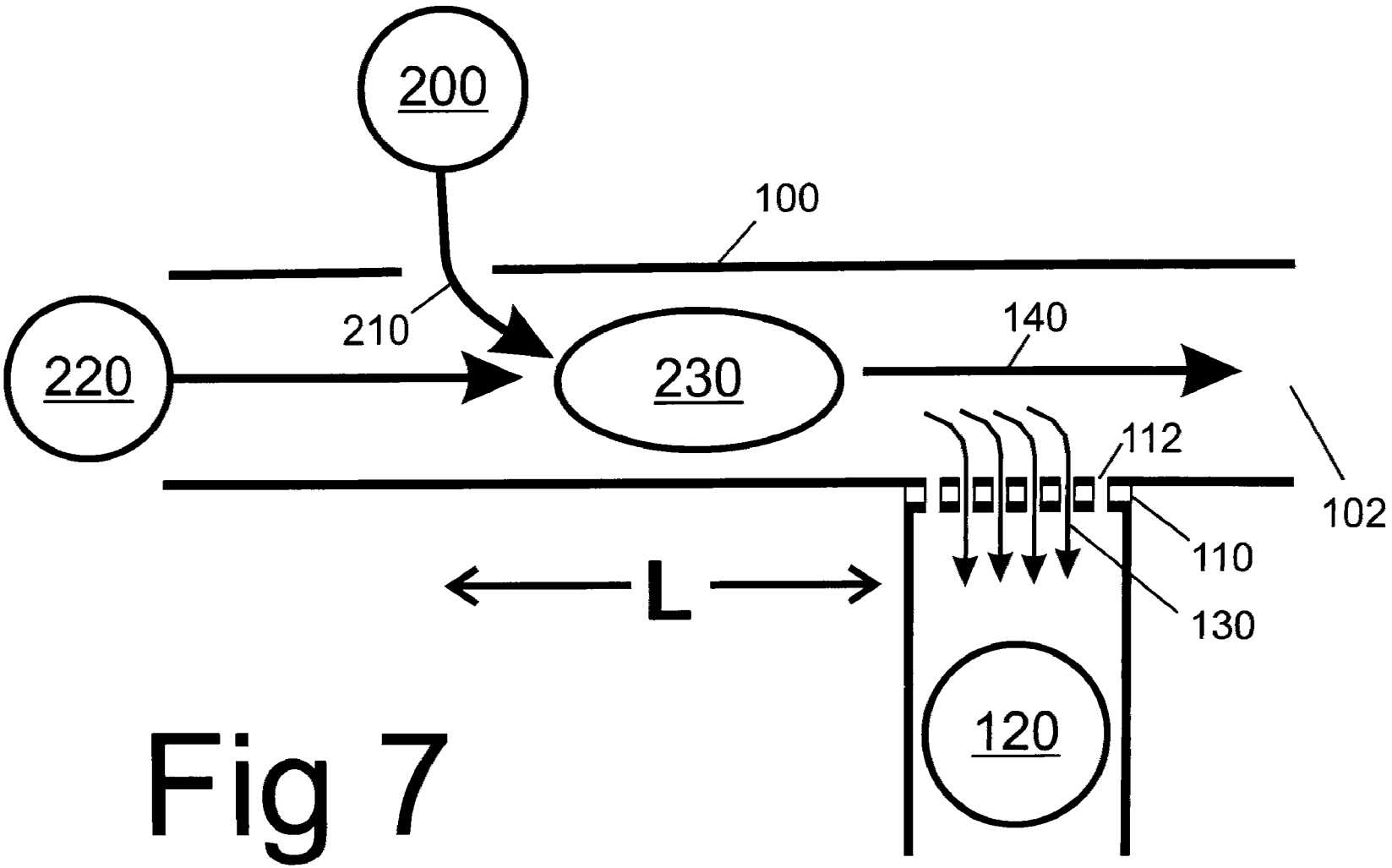
FIG. 7 shows a cross-sectional view of a tubular inlet with sample being introduced into the entrance of the tube mixing with reagent ions, introduced downstream of the entrance to produce product ions that flow downstream and are then subsequently sampled into a gas-phase ion analyzer through an orthogonally positioned ISA.
Figure 8:
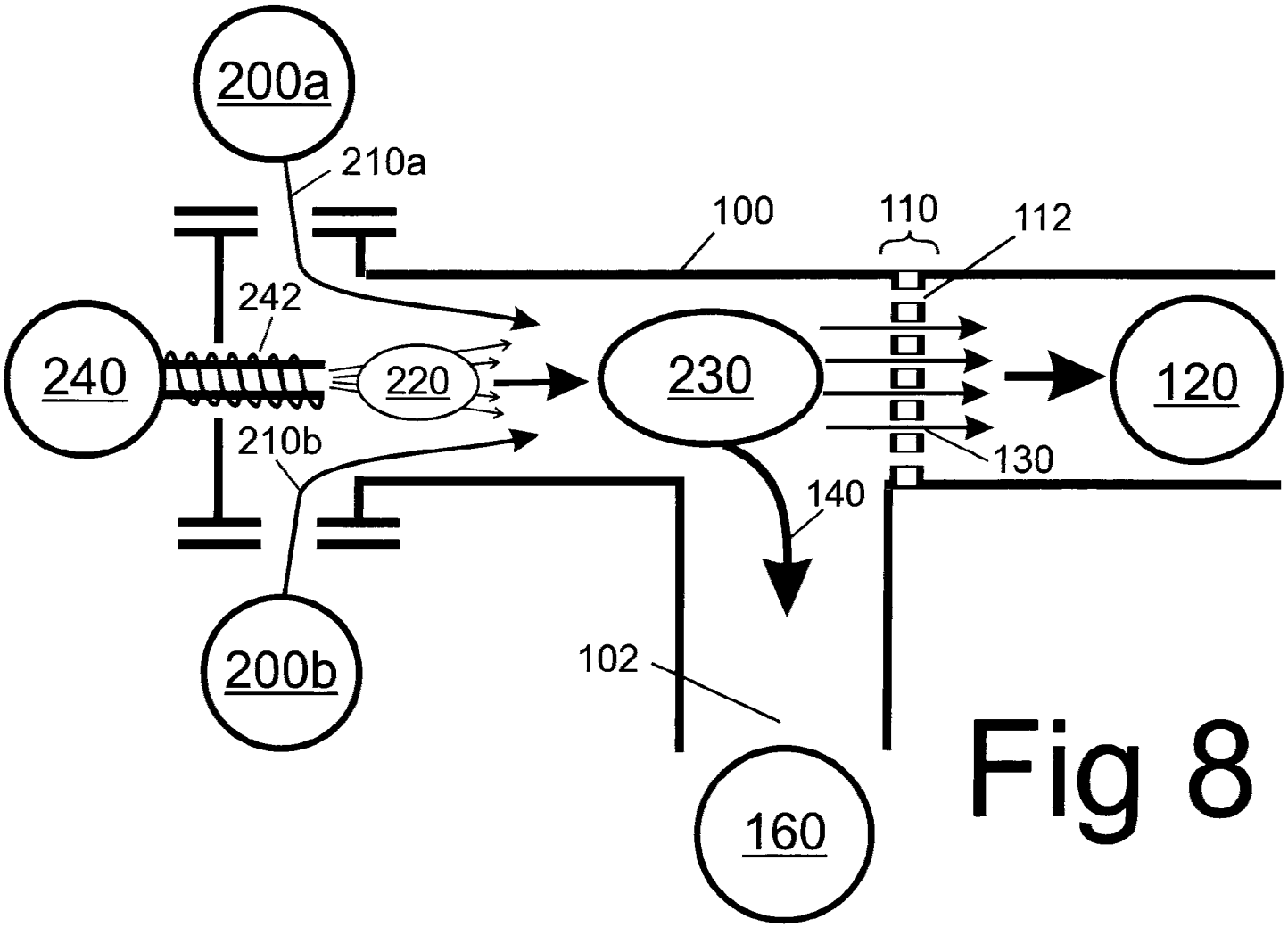
FIG. 8 shows a similar cross-sectional view of a tubular inlet with sample being introduced into the entrance of the tube mixing with reagent ions, from multiple sources, introduced downstream of the entrance to produce product ions that flow downstream and are then subsequently sampled into a gas-phase ion analyzer through an axial ISA.

FIGS. 7 and 8—Alternate Embodiment (Reaction Chambers in Field-Free Tubes)

There are various possibilities with regard to the origin of the ions in the tube, for example, FIG. 7 illustrates an embodiment where reagent ions 210 are introduced into the tube 100 from a remote reagent ionization generator 200 upstream of the ion selective aperture 110 and reacting with gas-phase species 220 flowing through the tube forming product ions 230; with the product ions 230 and reagent ions 210 being sampled by an ion selective aperture 110 further downstream by a distance L. FIG. 8 illustrates an embodiment where reagent ions are introduced into the tube 100 from two remote reagent ionization generators 200*a*, 200*b* upstream of the ion selective aperture 110. Mixing and reacting with gas-phase species 220 producing product gas-phase ions 230. The gas-phase species 220 are introduced from a source 240 outside the tube and delivered into the tube by a delivery means 242. The source 240 and delivery means 242 can be comprised of a gas chromatograph and a heated transfer line; a high performance liquid chromatographic pump and column, an atmospheric pressure nebulizer, a thermospray nebulizer, or an electrospray source; or just a transfer tube.

Figure 9:
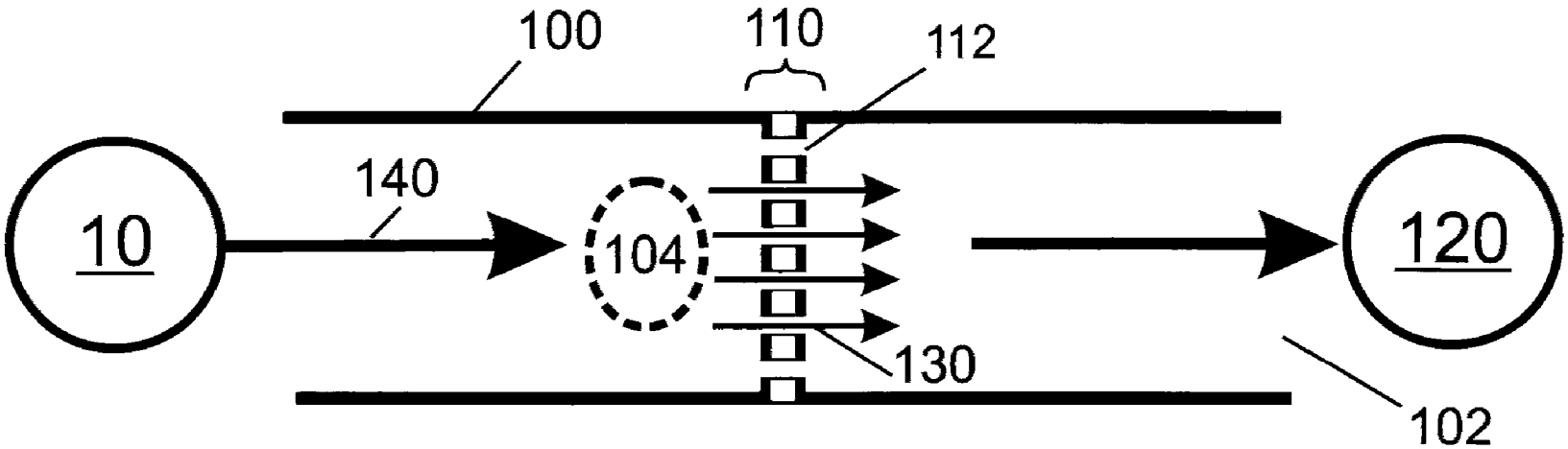
FIG. 9 shows a cross-sectional view of a tubular inlet with an axial ISA array with no exhaust flow

FIG. 9 is a cross-section of a simple tube geometry with no upstream exhaust. In this case, tube flow and ion transmissions are both governed by conductance through the ion selective aperture.

Operation—FIGS. 2 Thru 8

The exit of the tube is operated as a field-free or near field-free region upstream of the ion-selective aperture. By establishing a DC potential difference between this field-free region and the ion-selective aperture gas-phase ions in the tube are focused into the plurality of openings in the ion-selective aperture and substantially all of the ions are delivered into the adjacent region and are further transmitted to an ion detector, such as but not limited to a mass spectrometer or ion mobility detector. The potential difference between the tube and the ion selective aperture results in the ions flowing into the plurality of openings and passing into the adjacent region. At the same time the amount of gas passing into the adjacent region is limited by the conductance of the openings. For example, other operating parameters are possible for transmitting positive ions, the tube can be +100 volts, the three metal laminates at +50, 0, −50 volts; or to transmit negative ions the tube can be 0 volts while the three metal laminates are +50, +100, +150 volts, respectively.

The tube can be various lengths. All that is required is to maintain a high flow of gas at or near atmospheric pressure throughout the length of the tube. For example, FIG. 2 shows an opening in the wall of the tube where the majority of the gas flowing through the tube pass into the opening; while FIG. 5 shows the majority of the gas flowing along the central axis of the tube. These means of maintaining a high flow of ions through the tube can be used to transport ions long distances without substantial diffusion losses.

The tube can also serve as a reaction chamber, for example, FIGS. 7 and 8. FIG. 7 shows a tube with gas-phase species being swept through the tube, reacting with reagent ions introduced into this stream with product ions, resulting from this interaction, being sampled further down the tube at an ion selective aperture. The majority of the gas continues past the ion selective aperture and exits out of the tube further downstream. FIG. 8 shows a tube with gas-phase species being introduced into the tube from an gas chromatograph with a heated transfer line; a high performance liquid chromatographic pump, an atmospheric pressure nebulizer, thermospray nebulizer, an electrospray source; a transfer tube, etc.

ADVANTAGES

From the description above, a number of advantages of our tubular inlet become evident:

(a) A high flow of gas, at or near atmospheric pressure, from the source of gas-phase ions to the ion-selective aperture will eliminate or reduce the loss of ions at the entrance to the inlet; permitting collecting and focusing substantially all ions into and through the inlet.

(b) The ion selective aperture will isolate the contents of the inlet from the adjacent region.

(c) With an ion selective aperture separating the adjacent region from the components in the inlet, higher gas flows can be maintained through the inlet while the flow into the adjacent region is minimal.

(d) With an ion selective aperture separating the adjacent region from the inlet, flows of 100's to 1000's of $cm^3$/min at or near atmospheric pressure can be maintained in the inlet and dominate the movement of ions in a field-free manner while flow into the adjacent region is minimal;

(e) The presence of an ion selective aperture between the inlet and the adjacent region will provide a means decreasing the flow of gas into the adjacent region; and will prevent gaseous components, both neutral and charged, from entering the adjacent region.

(f) The presence of an ion selective aperture will permit the composition inside the inlet to be different from the adjacent region.

(g) The presence of an electrostatic potential difference across the ion selective aperture will permit or prevent the transfer of gas-phase ions from the inlet into the adjacent region.

(h) The presence of a high flow of gas flowing through the inlet will permit the position of the ion source to be independent of the ion detector.

(i) The presence of a high flow of gas flowing through the inlet will permit the use of various types of atmospheric ion sources without the need to modify the ion selective aperture for each particular ion source.

Conclusion, Ramification, and Scope

Accordingly, the reader will see that the tubular inlet of this invention can be used to collect and introduce a highly charged aerosol of gas-phase ions and charged particles into a field-free tube and deliver subsequently all of the gas-phase ions to an ion-selective aperture. In addition, the tubular inlet can be used to collect and introduce gas-phase ions and highly charged aerosols from field-free regions or surfaces, without the electric fields of the ion source impairing the ability to collect and focus these charged components. Furthermore, the tubular inlet has the additional advantages in that:

- it permits the collection and focusing of substantially all the ions in a large volume into the tubular inlet without loses due to dispersive electrostatic forces present at the entrance and through the entire length of the inlet;
- it permits the isolation of the ion source from an adjacent region;
- permits the use of a directed high gas flow through the tubular inlet relative to the adjacent region;
- it allows gas flow of 100's to 1000's of $cm^3$/cm, at or near atmospheric pressure, through the tubular inlet;
- it limits the introduction of gas into the adjacent region;
- it provides an ion selective aperture for preventing the gaseous components from the inlet from entering the adjacent region;
- it permits the gaseous composition inside the tubular inlet to be different from the composition in the adjacent region;
- it provides a tubular inlet in which the placement of the detector is not dependent on the physical location of the ion source;
- it provides a tubular inlet which can be used with a variety of atmospheric ion sources remote to the tubular inlet, such as, but not limited to electrospray, atmospheric pressure chemical ionization, photoionization, etc; and
- it provides a tubular inlet along with an atmospheric pressure ion source, such as but limited to electrospray, photo-ionization, etc. to be incorporated into a portable or benchtop chemical analyzer, the analyzer itself comprised of gases or gas inlets, electronics, gas and electronic controllers, and gas-phase ion detector, such as but not limited to mass, ion mobility, or differential mobility spectrometers, or combination thereof.

Although the description contains many specifications, these should not be construed as limiting the scope of the invention but as merely providing illustrations of some of the presently preferred embodiments of this invention. For example, the tubular inlet and ion selective aperture can be constructed as a totally integrated or monolithic structure or as separate components which can disassembled and reassembled as necessary; the internal volume of the tubular inlet can be variable; the size and length of the tubular inlet can be variable; the opening of the inlet can be round, oval, rectangular, etc.; the potentials of the tubular inlet and ion-selective aperture can be adjusted manually or by computer control to obtain optimum performance; the gas flow through the inlet can be adjusted manually or by computer control to obtain optimum performance; various gases may be used, such as but not limited to nitrogen or air; the inlet can be constructed of electrically conductive and insulating materials, such as but not limited to silica, glass, metal coated insulator, stainless steel, Teflon, Vespel, dielectric coated glass, composites, and combination thereof; the adjacent region downstream of the tubular inlet can house ion optical components, such as, lenses, radio frequency ion guides, skimmers, etc.

Thus the scope of the invention should be determined by the appended claims and their legal equivalents, rather than by the examples given.

We claim:

1. An atmospheric pressure ion sampling device for mass spectrometry comprised of:

a. a tube, said tube with an entrance and an exit;

c. a field-free or near field-free region disposed downstream of said entrance;

d. an atmospheric pressure interface adjacent said field-free or near field-free region, said interface is an ion-selective aperture array;

e. a means for establishing a gas flow at or near atmospheric pressure from said ion source, into and along the entire length of said tube, through said field-fee region to said aperture array; and;

f. supplying direct current electrical potentials to said tube and aperture array for establishing and maintaining said field-free region;

whereby substantially all gas-phase ions or charged particles from said ion source, are swept by concurrent viscous forces of said gas flow into said entrance and through said tube to said field-free region and introduced into said mass spectrometer through said ion-selective aperture array for subsequent collection and analysis.

2. The device of claim 1, wherein said gas-phase ions or charged particles are formed in said atmospheric pressure ion source by the processes of generating a highly charged aerosol of gas-phase ions, charged droplets or combination thereof; by electrospraying a liquid, gas discharge, photoionization, chemical reaction between neutral gas-phase molecules and reactant ions or gas-phase charged species, or combinations thereof.

3. The device of claim 1, wherein said mass spectrometer is comprised of an ion optics assembly, an ion mobility spectrometer, or combinations thereof.

4. The device of claim 1, wherein said means of establishing said gas flow, at or near atmospheric pressure, by a pumping means or pressurization means to establish a pressure gradient across said tube, wherein said pressure gradient is minimal, going from slightly above atmospheric pressure to atmospheric or near atmospheric pressure, or from atmospheric or near atmospheric pressure to slightly below atmospheric pressure.

5. The device of claim 1, wherein said tube and aperture array are temperature controlled; maintaining the temperatures of said tube and aperture array at prescribed levels.

6. The device of claim 1, wherein said tube is comprised of metal, a dielectric material, and combinations thereof in a contiguous fashion.

7. The device of claim 1, wherein said tube is comprised of a plurality of tubular elements, said elements consisting of alternating sections of metal electrodes and dielectric insulators, said metal electrodes are supplied with electric potentials by connection to a voltage supply, whereby the same electric potential is maintain from said ion source through said tube, thereby establishing and maintaining said field-free region.

8. The device of claim 1, wherein said ion-selective aperture array consists of at least three layers, an insulating or dielectric layer sandwiched between two metal layers, and populated with at least one opening or passage, said metal layers supplied with individual attracting electric potentials, whereby substantially all ions and ionic particles flowing through said near field-free region and passing in close proximity to said ion-selective aperture array are subsequently introduced into said mass spectrometer through said ion-selective aperture array.

9. The device of claim 8, further comprised of an additional means of flowing gas; whereby said additional means of flowing gas is introduced into said near field-free region from said array to selectively control the mobility of said ions and neutral gases moving through said near field-free region towards said array.

10. An inlet at or near atmospheric pressure for collecting, focusing and directing gas-phase ions, neutral gases, ionic particles or combinations thereof, from an atmospheric or near atmospheric pressure ion source for collection or chemical analysis, inlet comprised of:

a. a tube, said tube comprised of an entrance and an exit and supplied with a first direct current potential;

b. a means of establishing a flow of gas at atmospheric or near atmospheric pressure into said entrance and through said tube;

c. an ion-selective aperture array disposed downstream of said entrance and in the wall of said tube, the disposition of said array creating a near field-free region adjacent and upstream of said array and creating an interface between the inside of said tube and an adjacent region at lower pressure, said array comprised of, an insulating or dielectric layer sandwiched between two metal laminates, one topside, downstream of said near field-free region the other bottom-side, downstream of said dielectric, said array populated with a plurality of openings or passages, said metal laminates supplied with individual direct current potentials, a second potential supplied to said topside laminate and a third potential supplied to bottom-side laminate, said first and second potentials at the same potential establishing and maintaining said field-free region;

whereby substantially all said ions or ionic particles from said ion source are swept by said gas flow at or near atmospheric pressure into and through said tube, said field-free region and delivered to said aperture array where said ions are directed by said potential from said bottom-side metal laminate into said adjacent region for collection or chemical analysis.

11. The device of claim 10, wherein said gas-phase ions or ionic particles are formed at atmospheric or near atmospheric pressure by the processes of electrospraying a liquid, gas discharge, photo-ionization, laser desorption, charged or neutral liquid desorption or ablation, chemical reaction between neutral gas-phase molecules and reactant ions, or combinations thereof, upstream or at said entrance of said tube.

12. The device of claim 10, wherein said adjacent region is occupied by an ion optics assembly, an aperture or tubular inlet to a mass or an ion mobility spectrometer, or combinations thereof, for collection or chemical analysis of said ions or ionic particles.

13. The device of claim 10, wherein said tube and aperture array are temperature controlled; maintaining the temperatures of said tube and aperture array at prescribed levels.

14. The device of claim 10, wherein said tube is comprised of metal, a dielectric material, and combinations thereof in a contiguous fashion.

15. The device of claim 10, further comprised of a means of flowing a counter-flow gas, said counter-flow gas is introduced near said aperture array in order to control the motion of said ionic and neutral components, present in said gas flow, passing through and exiting said near field-free region and subsequently approaching said array.

16. A method of sampling ions from atmospheric pressure for mass spectral analysis, comprising:

a. providing a tube, said tube with an entrance and an exit;

c. providing a field-free or near field-free region disposed downstream of said entrance;

d. providing an atmospheric pressure interface adjacent said field-free or near field-free region, said interface is an ion-selective aperture array;

e. providing a means for establishing a gas flow at or near atmospheric pressure from said ion source, into and along the entire length of said tube, through said field-fee region to said aperture array; and;

f. providing direct current electrical potentials to said tube and aperture array for establishing and maintaining said field-free region;

whereby substantially all gas-phase ions or charged particles from an ion source are swept by concurrent viscous forces of said gas flow into said entrance and through said tube to said field-free region and introduced into a mass spectrometer through said ion-selective aperture array for subsequent collection and analysis.

17. The method of claim 16, wherein said gas flow, and any neutral or ionic components that comprise said gas flow, are restrained from passing into said chemical analyzer by adding an additional gas-flow to said near field-free region, in a counter-flow manner to said gas flow flowing through said tube, providing a barrier to said components that comprise said gas flow.

18. The method of claim 16, wherein said ions, charged particles, and combinations thereof, from said atmospheric pressure ion source are provided by the process of electrospraying a liquid, a gas discharge, photo-ionization, chemical reactions between neutral gas-phase molecules and reactant ions or gas-phase charged species, or combinations thereof.

19. The method of claim 16, wherein said tube is comprised of metal, a dielectric material, or combinations thereof in a contiguous fashion.

20. The method of claim 16, wherein said mass spectrometer is comprised of an ion optics assembly, an ion mobility spectrometer, or combinations thereof.

* * * * *